United States Patent [19]

Gilmour et al.

[11] Patent Number: 4,813,843

[45] Date of Patent: Mar. 21, 1989

[54] APPARATUS FOR TURNING A VEHICLE ON ITS SIDE

[75] Inventors: Joseph T. O. Gilmour; Glen M. Langset, both of Fruitvale, Canada; Borden T. N. Gilmour, Bluebird Road, Box 566, Fruitvale, British Columbia, Canada, V06 1L0

[73] Assignee: Borden T. N. Gilmour, Fruitvale, Canada

[21] Appl. No.: 171,736

[22] Filed: Mar. 22, 1988

[51] Int. Cl.[4] ..... B66F 7/22

[52] U.S. Cl. ..... 414/678; 254/94; 269/55; 414/777

[58] Field of Search ..... 414/359, 360, 371, 372, 414/576, 678, 777, 778, 782; 254/94; 264/55

[56] References Cited

U.S. PATENT DOCUMENTS

| | | | |
|---|---|---|---|
| 1,266,094 | 5/1918 | Beckman | 414/777 X |
| 1,291,610 | 1/1919 | Nicoson | 414/678 |
| 1,507,911 | 9/1924 | Eichman | 269/55 X |
| 1,615,860 | 2/1927 | Williams | 414/678 X |
| 2,171,404 | 8/1939 | Paine | 414/678 X |
| 2,583,877 | 1/1952 | Peyron | 414/678 X |
| 3,087,631 | 4/1963 | Kocher | 414/678 |
| 3,674,252 | 7/1972 | Crabtree et al. | 414/678 |
| 4,744,717 | 5/1988 | Dyer | 414/678 |

FOREIGN PATENT DOCUMENTS

| | | | |
|---|---|---|---|
| 382673 | 10/1923 | Fed. Rep. of Germany | 414/359 |
| 528226 | 6/1931 | Fed. Rep. of Germany | 414/678 |
| 2805142 | 8/1978 | Fed. Rep. of Germany | 414/678 |
| 132987 | 10/1960 | U.S.S.R. | 414/359 |
| 227464 | 6/1925 | United Kingdom | 414/678 |
| 623564 | 5/1949 | United Kingdom | 414/678 |

OTHER PUBLICATIONS

2 Sheets from Book of Inventions the Bizarre and Future, pp. 187 and 188, Referring to Roulis 2000(1983) and Photograph Advertising brochure for Greenbelt Systems Inc. Disclosing a Roto-Hoist.

*Primary Examiner*—Leslie J. Paperner

*Attorney, Agent, or Firm*—Bull, Housser & Tupper

[57] ABSTRACT

An apparatus for turning a vehicle on its side comprises a turning member and a supporting device for supporting the turning member for rotation about a generally horizontal first axis of rotation. The supporting device is rotatably connected to the turning member. The apparatus further comprises a brake for braking movement of the turning member relative to the supporting device. The brake operatively interacts between the turning member and the supporting device. The apparatus also includes first and second connecting devices for connecting a first wheel hub and a second wheel hub of the vehicle to the turning member. The apparatus further includes positioning devices for positioning the first and second connecting devices to align the first axis of rotation with the longitudinal center of mass of the vehicle, the positioning devices being operatively connected to the first and second connecting devices.

9 Claims, 6 Drawing Sheets

FIG. 1
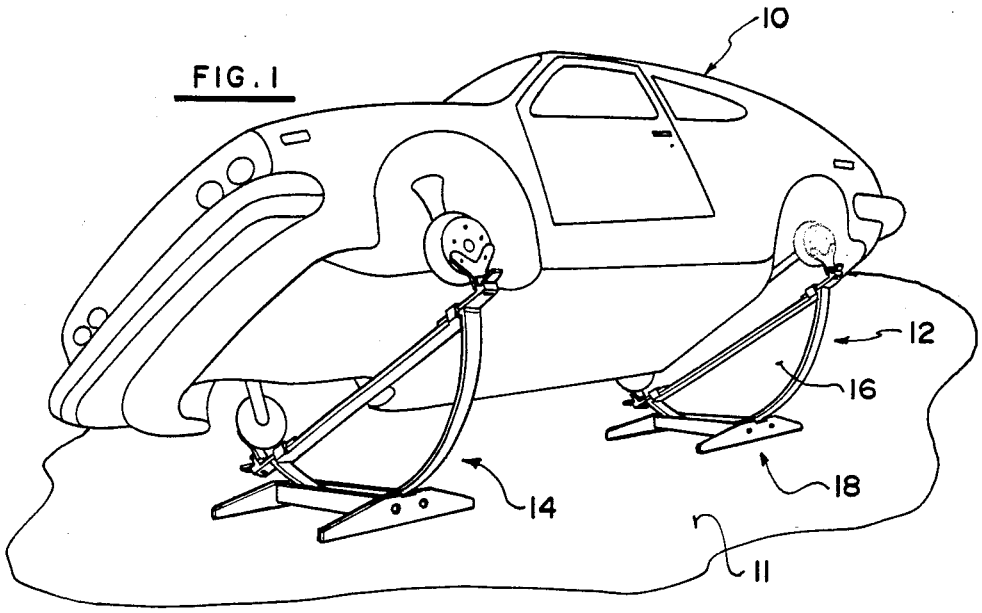
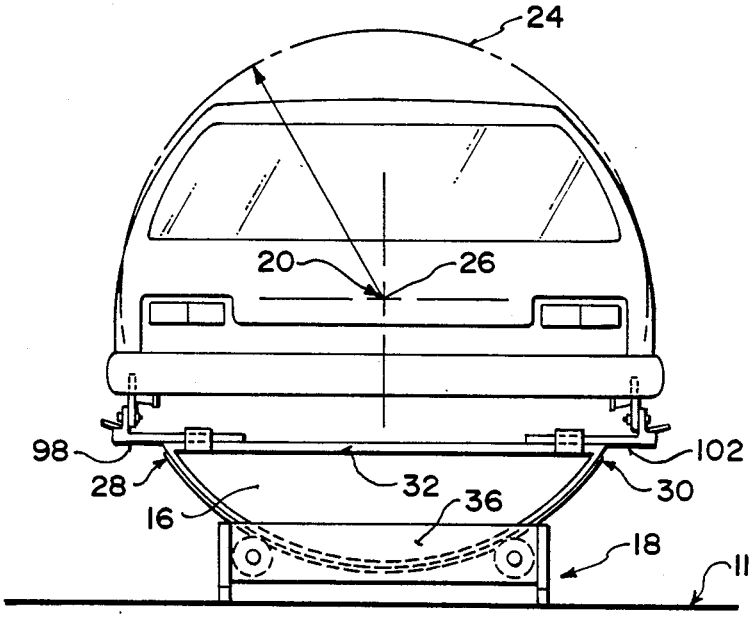
FIG. 2

APPARATUS FOR TURNING A VEHICLE ON ITS SIDE

BACKGROUND OF THE INVENTION

The invention relates to a device for turning and supporting a vehicle on its side.

DESCRIPTION OF THE PRIOR ART

Persons wishing to perform body work on a roof, hood, lower door panel, quarter panel or rocker panel of a vehicle often have difficulty in gaining access to these areas. For instance, to work on the upper areas of the vehicle, such as the roof or hood of the vehicle, often a step ladder or scaffolding is necessary to support a worker for access to these upper areas. Similarly, to work on the lower areas of the vehicle, a worker often must crouch down or lay on the floor. This makes such work on the vehicle quite awkward. Although the vehicle may be raised to gain access to its lower areas, a hydraulic lift to raise the vehicle to a comfortable working height is relatively expensive and impractical for many smaller body shops and the home bodyman. In addition, should the vehicle be raised to a comfortable height to make the vehicle's lower areas accessible, the hood and the roof areas become generally inaccessible and therefore cannot be worked on simultaneously with the lower areas.

Prior art relating to devices which enable a vehicle to be turned on its sides, tends to describe devices which are generally very large and quite elaborate, making them also generally too expensive and too bulky for the small body shop and home bodyman.

An example of a rather elaborate device is described in U.S. Pat. No. 3,087,631 issued to Kocher which describes an apparatus for turning an automobile on its side. The apparatus requires two very large circular hoops, track members, and electric motors to rotate the vehicle. Similar devices are described in U.S. Pat. Nos. 1,507,911 (Eichman), 1,615,860 (Williams) and 1,291,610 (Nicoson). All of the aforementioned references describe devices which tend to be too expensive and impractical for a small body shop or the home bodyman.

The present invention overcomes the problems with the prior art by providing an apparatus for turning and supporting a vehicle on its side which is quite compact and relatively inexpensive. The apparatus comprises a turning member and supporting means for supporting the turning member for rotation about a generally horizontal first axis of rotation, the supporting means being supported on a surface such as the ground and the turning member being rotatably connected to the supporting means. The apparatus further includes braking means for braking movement of the turning member relative to the supporting means, the braking means operatively interacting between the turning member and the supporting means. The apparatus further comprises first and second connecting means for connecting a first wheel hub and a second wheel hub respectively, of the vehicle, to the turning member. The apparatus further comprises positioning means for positioning the first and second connecting means to align the generally horizontal first axis of rotation with the longitudinal center of mass of the vehicle, the positioning means being operatively connected to the first and second connecting means.

Two generally similar apparatuses of the present invention are required to turn the vehicle on its side. Use of the apparatus facilitates body panel repairs, particularly of the more difficult areas such as the roof, hood, lower door panels, quarter panels and rocker panels. The vehicle may be turned on its side about its longitudinal center of mass through a total angle of approximately 70 degrees raising a rocker panel on either side of the vehicle to approximately 34 inches above the ground. At this height a worker may perform his work in a comfortable position.

In addition as the lower areas of the vehicle are being repaired by a first worker, the roof or hood of the vehicle may be repaired simultaneously by a second worker. It will be seen that the apparatus described herein and below is relatively inexpensive and compact and therefore more practical for the small body shop or home bodyman, than are the devices described in the prior art.

BRIEF DESCRIPTION OF THE DRAWINGS

FIG. 1 is a simplified perspective view of a pair of apparatuses according to the invention shown installed under a vehicle turned partly on its side;

FIG. 2 is a simplified end view of one of the apparatuses of FIG. 1 installed under a level vehicle;

DESCRIPTION OF THE PREFERRRED EMBODIMENTS

Referring to FIG. 1, a vehicle 10 is shown mounted on a first apparatus 12 and a second apparatus 14, for turning the vehicle on its side. The vehicle is turned on its side about its longitudinal center of mass.

Figures 3, 3A:
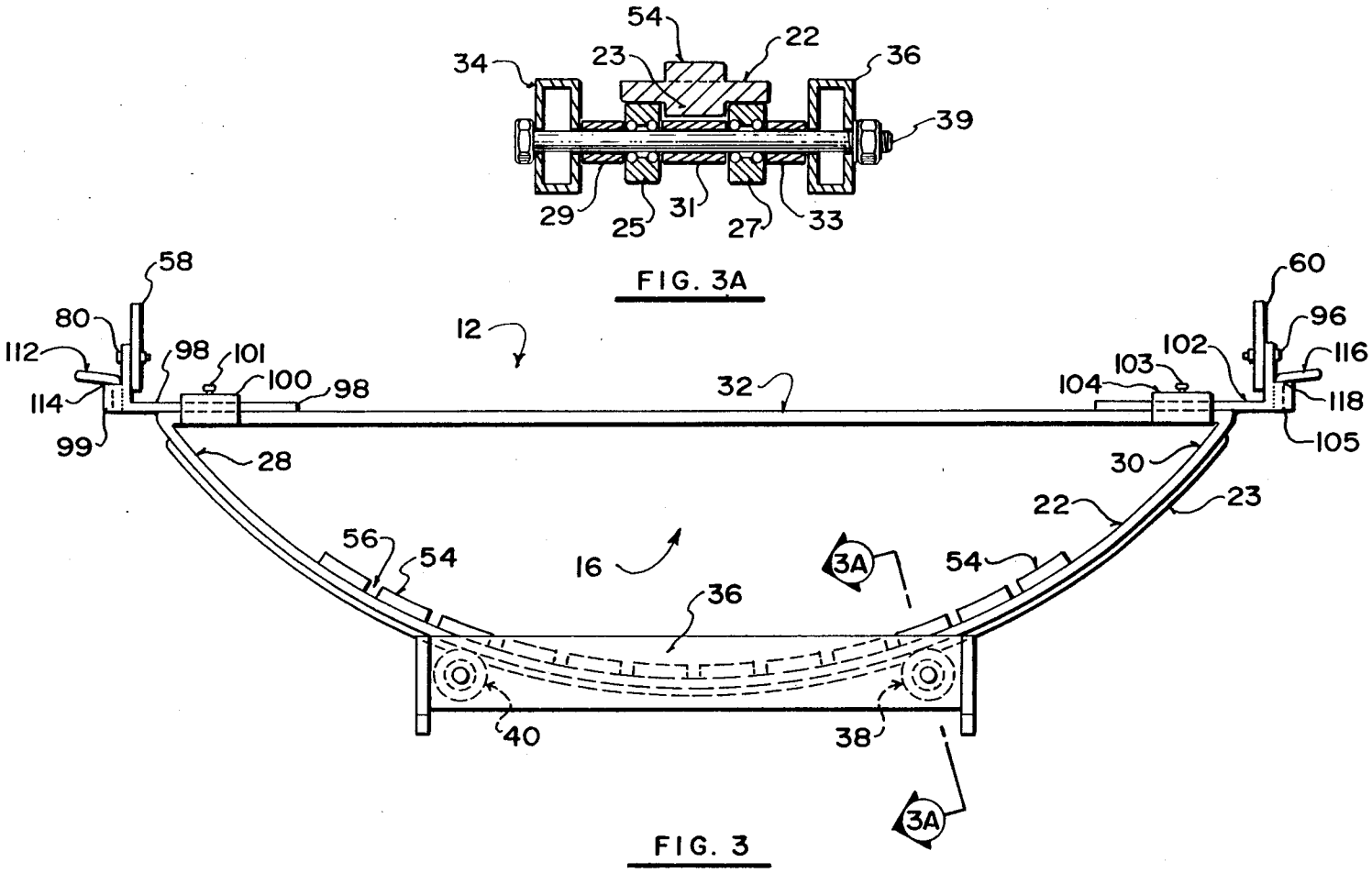
FIG. 3 is a simplified enlarged end view of the one apparatus of FIG. 2.
FIG. 3*a* is a simplified, fragmented cross sectional view of the apparatus of FIG. 3 taken along lines 3*a*3*a*.

Referring to FIG. 2, the first apparatus 12 is shown. The second apparatus 14 is generally similar, the differences being described below. Apparatus 12 has a turning member shown generally at 16 and also includes a support shown generally at 18. The support 18 serves as means for supporting the turning member 16 for rotation about a generally horizontal first axis of rotation 20. The support 18 is supported on a surface 11, such as the ground, and the turning member 16 is rotatably connected to the support 18. Referring to FIG. 3, the turning member 16 includes an arcuate member 22 having a rail 23, wherein both the arcuate member and the rail conform to an arc of a circle 24 shown in FIG. 2. The circle has a center 26 coincident with the center of curvature of the arcuate member. The first axis of rotation 20 passes through center 26.

Referring to FIG. 3, the arcuate member has a first end portion 28 and a second end portion 30. A first cross member 32 is connected between the first and second end portion to provide bracing means for bracing the first and second end portions.

In the preferred embodiment, it has been found that the apparatus permits the center of mass of most cars to be aligned with the first axis of rotation 20, provided that the straight line distance from the first end portion 28 to the second end portion 30 and the distance from the bottom of the arcuate member to the center of the first cross-member are in a ratio of between 3:1 and 5:1. The preferred ratio is 4:1.

Figure 4:
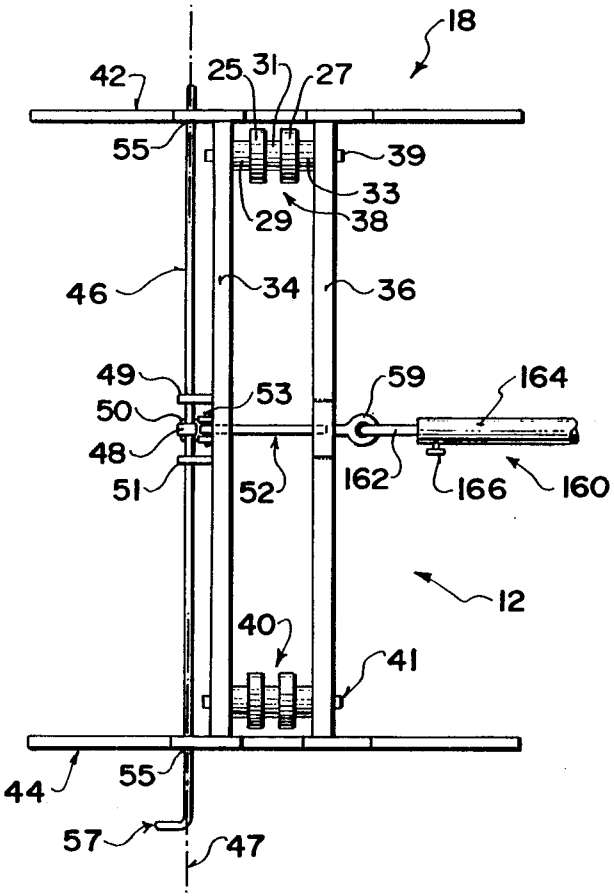
FIG. 4 is a simplified plan view of the support for the apparatus of FIG. 3.

Referring to FIG. 4, the support 18 includes a first guide member 34 and a second guide member 36 parallel to and spaced-apart from the first guide member. A first bearing shown generally at 38 is rotatably mounted on an axle 39 between the first and second guide members. The first bearing comprises first and second rollers 25 and 27 which are separated from each other and spaced-apart from the first and second guide members, by spacers 29, 31 and 33. A second bearing shown generally at 40 is similar to the first bearing, and is parallel to and spaced-apart from the first bearing and is similarly mounted on an axle 41.

Referring to FIG. 3*a*, the turning member 16 is set on the first and second bearings 38 and 40, such that the rail 23 on the arcuate member 22 lies between the first and second rollers 25 and 27. This prevents sideways movement of the turning member 16 in the support 18. The underside of arcuate member 22 forms an arcuate surface, which rests on the first and second bearings, specifically the rollers, for rotation of the turning member 16 about the axis of rotation 20. The rail 23, in combination with the spaced-apart rollers 25 and 27, provide means for guiding the turning member 16.

Referring back to FIG. 4, the support 18 further comprises first and second outriggers 42 and 44 connected to respective ends of the guide members 34 and 36. The outriggers 42 and 44 provide stabilizing means for stabilizing the support 18 to prevent tipping on the surface 11.

The apparatus 12 further comprises braking means for braking the movement of the turning member 16 relative to the support 18, the braking means operatively interacting between the turning member 16 and the supporting means 18. Referring to FIG. 4, the braking means in this embodiment includes a rod 46 rotatably connected to the first guide member 34 by journal bearings 49 and 51 and is similarly supported by journals 55 in outriggers 42 and 44 for rotation about its longitudinal axis 47.

Figure 6:
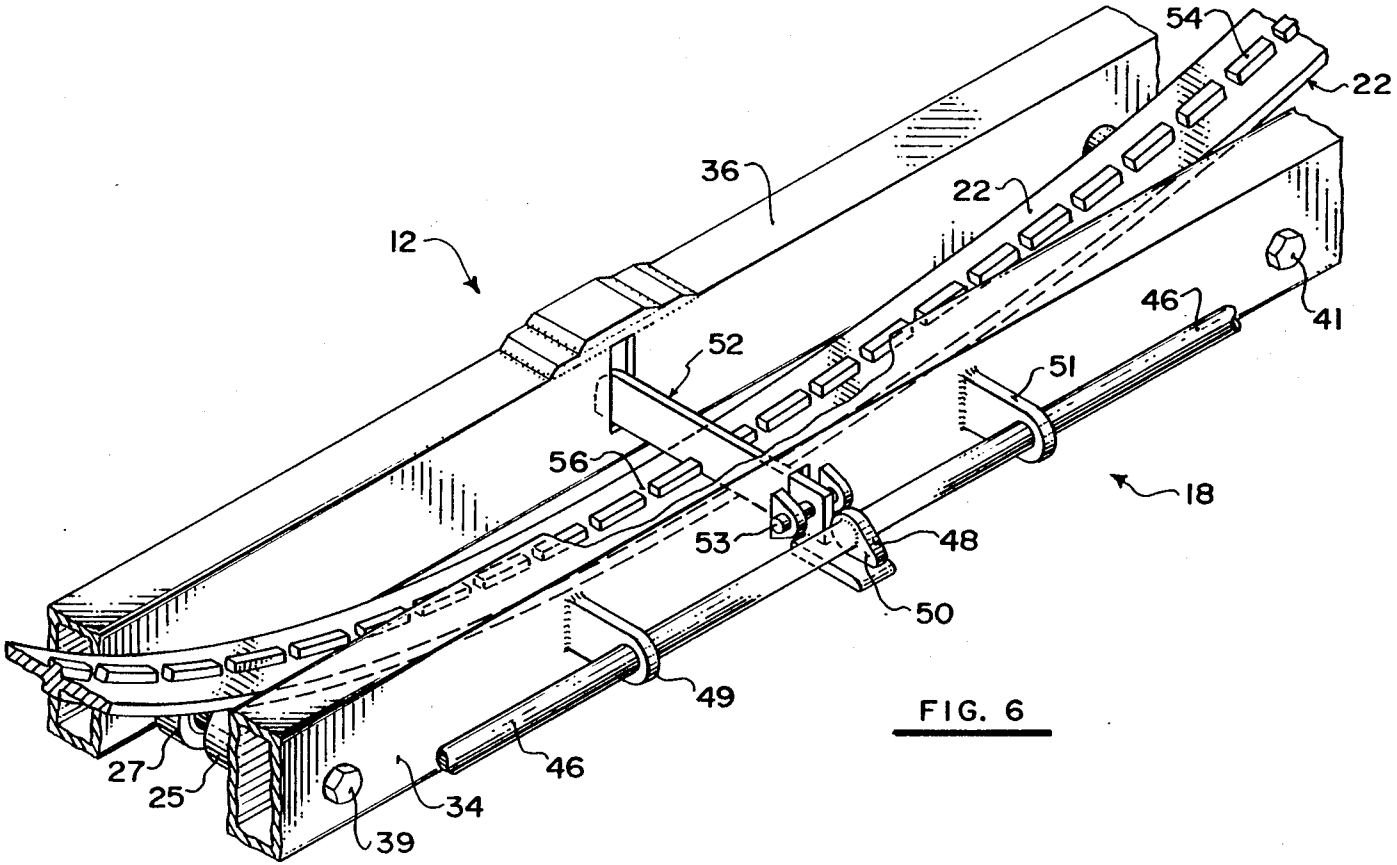
FIG. 6 is a simplified perspective view of the braking device for the apparatus of FIG. 3.

A cam 48 having a lobe 50, seen best in FIG. 6, is operatively connected to the rod 46, whereby the cam 48 can be rotated by rotating the rod 46 by means of its handle 57. A pawl 52 is pivotally connected to the first guide member 34, by a pivot pin 53, the pawl member being contacted by the lobe 50. Rotation of the rod 46 causes rotation of the cam member 48, thereby causing the lobe 50 to rotate the pawl 52 about the pivot pin 53.

The braking means further includes a plurality of teeth 54 spaced-apart by interdental spaces 56. The teeth 54 are connected to the arcuate member 22 by welding or other conventional means. The spaces 56 each can selectively receive the pawl 52 therebetween.

Braking of the turning member 16 is effected by rotating the rod 46, thereby rotating the cam member 48 to cause the lobe 50 to move away from the pawl 52. The pawl 52 is biased downwardly by gravity and thus rotates to engage with one of the spaces 56, thereby engaging the teeth 54 and preventing rotation of the turning member 16.

Turning member 16 is released by rotating the rod member 46 with handle 57 in an opposite direction, thereby rotating the cam 48 to cause the lobe 50 to move toward the pawl 52. The pawl 52 is thus rotated upwardly by the lobe 50 and thereby disengages the teeth 54 allowing the turning member 16 to rotate freely.

Figure 7:
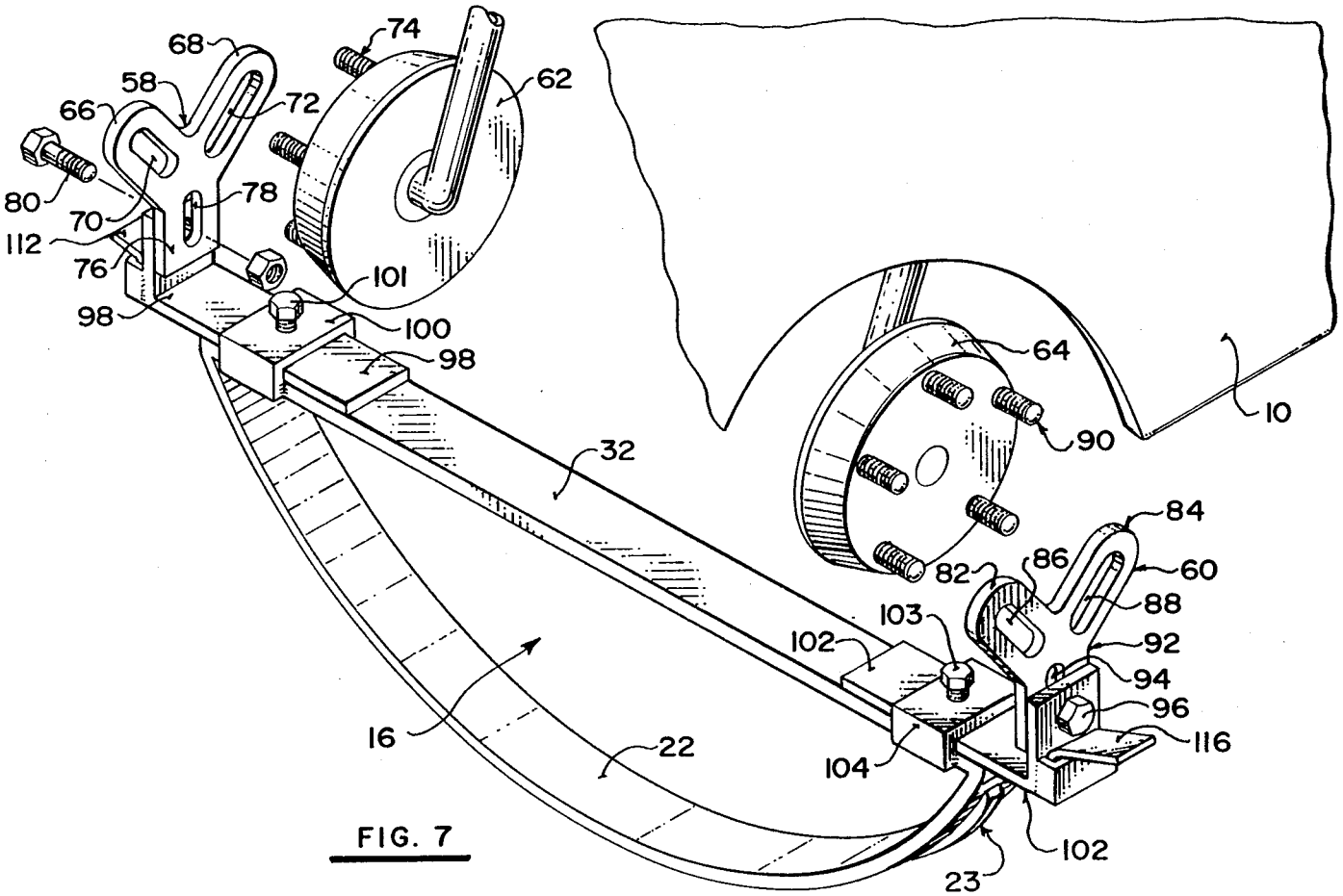
FIG. 7 is a simplified isometric view of the vehicle mounting component of the apparatus of FIG. 3.

Referring to FIG. 7, the apparatus 12 further includes a first wheel hub bracket shown generally at 58 and a second wheel hub bracket shown generally at 60, providing first and second connecting means for connecting a first wheel hub 62 and a second wheel hub 64 of the vehicle 10 to the turning member 16.

The first wheel hub bracket 58 has first and second projections 66 and 68, having first and second openings 70 and 72 respectively providing first receiving means for receiving wheel hubs of various sizes. The openings 70 and 72 receive a pair of wheel hub bolts 74 from the wheel hub 62. The wheel hub bracket 58 further includes a support 76 having a third opening 78 for receiving a first fastening means sauch as a bolt 80 for fastening the bracket 58 to the turning member 16.

Referring to FIG. 3, the first wheel hub bracket 58 is connected by the bolt 80 to a first track adjustment member 98. Member 98 can be selectively clamped along cross member 32 by a first clamp 100 attached to the first cross member 32 near the first end portion 28 of the arcuate member 22. A set screw 101 is used to clamp member 98 in the desired position.

Referring again to FIG. 7, the second wheel hub bracket 60 likewise has projections 82 and 84 with openings 86 and 88 respectively. The openings 86 and 88 can receive a pair of wheel hub bolts 90 from the second wheel hub 64. The second wheel hub bracket 60 further includes a support 92 having an opening 94 for receiving bolt 96, for fastening the second wheel hub bracket 58 to the turning member 16.

The openings 78 and 94 are vertically elongated to provide means for adjusting the wheel hub brackets vertically relative to the axis of rotation of the vehicle.

Referring to FIG. 3, the second wheel hub bracket 60 is similarly connected by the second bolt 96 to a second track adjustment member 102. A second clamp member 104 is attached to the first cross member 32 near the second end portion 30 of the arcuate member 22 and has a set screw 103.

The track adjustment members 98 and 102 and the clamp members 100 and 104 provide second adjustment means for adjusting the positions of the brackets 58 and 60 relative to the generally horizontal first axis of rotation 20. The members 98, 100, 102 and 104 provide for adjustment of the brackets 58 and 60 in a horizontal plane which is parallel to the surface 11, shown in FIG. 1, on which the apparatus 12 is positioned in an initial orientation for receiving the vehicle 10. The members 98, 100, 102, and 104 thereby provide positioning means for positioning the brackets 58 and 60 to align the first axis of rotation 20 with the longitudinal center of mass of the vehicle.

The first and second members 98 and 102, also have first and second foot pedal holders 99 and 105 respectively. These holders have slot-like internal sockets. A first foot pedal 112 having an angularly offset portion 114 is connected to the first track adjustment member 98 by inserting the portion 114 into the first foot pedal holder 99. Similarly, a second foot pedal 116 having a second angularly offset portion 118, is connected to the second track adjustment member 102 by inserting the portion into the second foot pedal holder 105. The pedals 112 and 116 enable an operator to apply foot pressure to either end of the turning member 16, thereby rotating the turning member 16 in a clockwise or counter-clockwise direction when the pawl is released from the teeth.

Figures 9, 10:
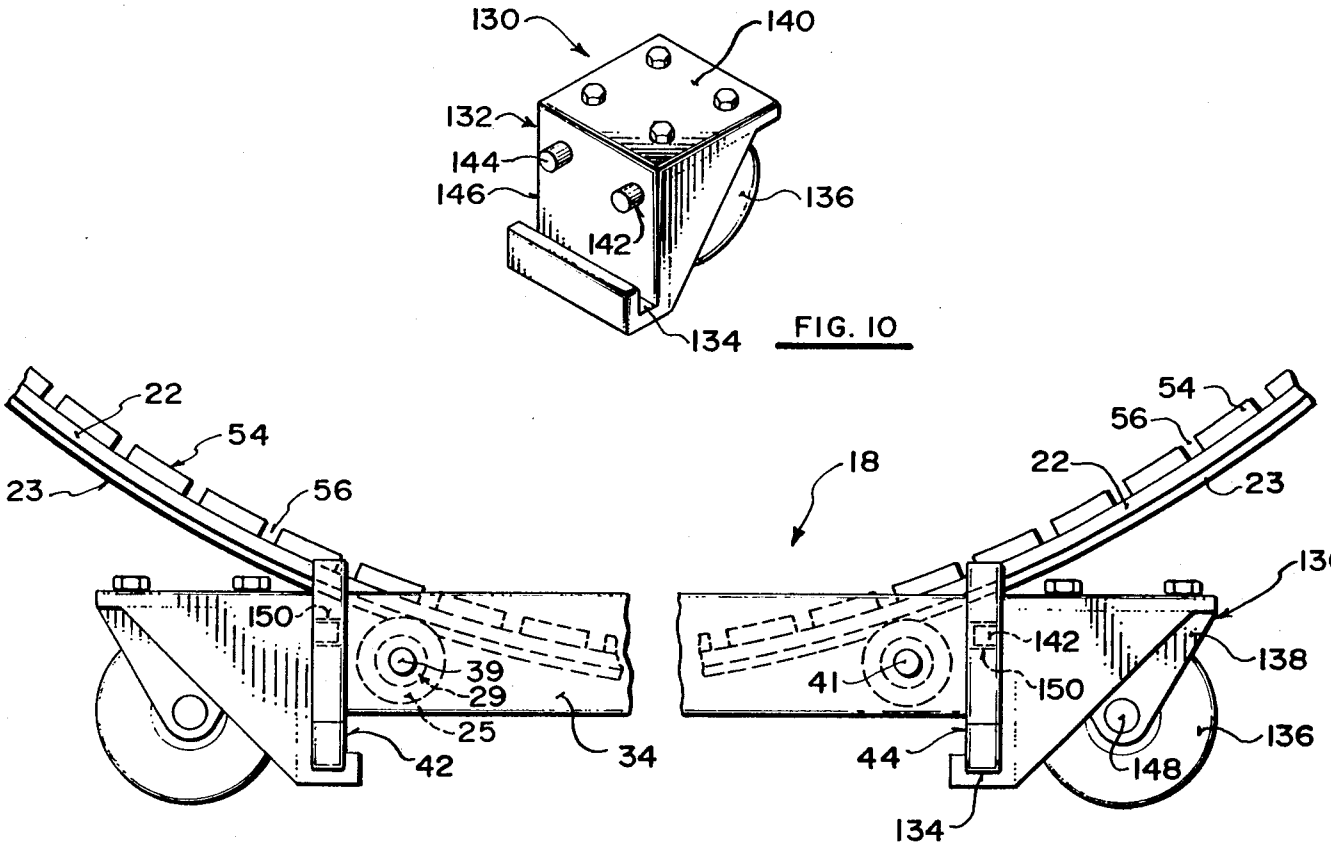
FIG. 9 is a simplified fragmentary side view of the support, having casters mounted thereon.
FIG. 10 is a simplified isometric view of a caster.

Referring to FIG. 9, the apparatus further comprises a plurality of casters, each of which is connectable to the first or second outriggers 42 and 44 of each support 18.

Referring to FIG. 10, a representative caster is shown generally at 130. The caster includes an L-shaped portion 132, having an outwardly facing channel portion 134 connected thereto. A wheel 136, is operably connected by forks (shown at 138 in FIG. 9), to a top portion 140 of the L-shaped portion. The caster also includes first and second pegs 142 and 144, which are connected to a side portion 146 of the L-shaped portion.

Referring back to FIG. 9, caster 130 is removably connected to outrigger 44, by placing outrigger 44 in the channel portion 134 of the caster. The weight of the outrigger creates a moment on the L-shaped portion about an axle 148 of the wheel 136, thereby tending to securely hold the caster in place. Registration of the caster is maintained by first and second pegs 142 and 144 inserted into registered holes 150, in the outrigger 44. Each of the four casters is installed on a respective outrigger in the same manner.

Referring back to FIG. 4, a spacing member, shown generally at 160, is used to hold the first and second supports in a spaced-apart position. This is particularly useful to maintain the spacing of the first and second supports, when the casters are employed. The spacing member 160 comprises an extendible portion 162, which telescopicallyslides in a fixed portion 164. The fixed portion has a locking mechanism comprised of a screw 166, which can be tightened to clamp the extendible portion in varying degrees of extension.

Figure 4A:
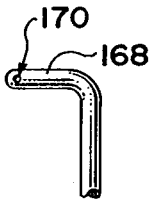
FIG. 4*a* is a simplified side view of a hooked end portion of a spacing member.

Both the fixed portion and the extendible portion have a hooked end portion 168, as illustrated in FIG. 4*a*. The hooked end portion has an aperture 170, for receiving a cotter pin (not shown) therethrough.

Referring back to FIG. 4, the spacing member is employed by loosening the screw 166 and inserting the hooked end portions into respective eyelets, such as shown at 59, on each support. Cotter pins are installed in respective apertures 170 in each of the hooked end portions 168, to secure the end portions in their respective eyelets. The screw 166 is tightened and the first and second supports are thus held spaced-apart by the spacing member.

Figure 5:
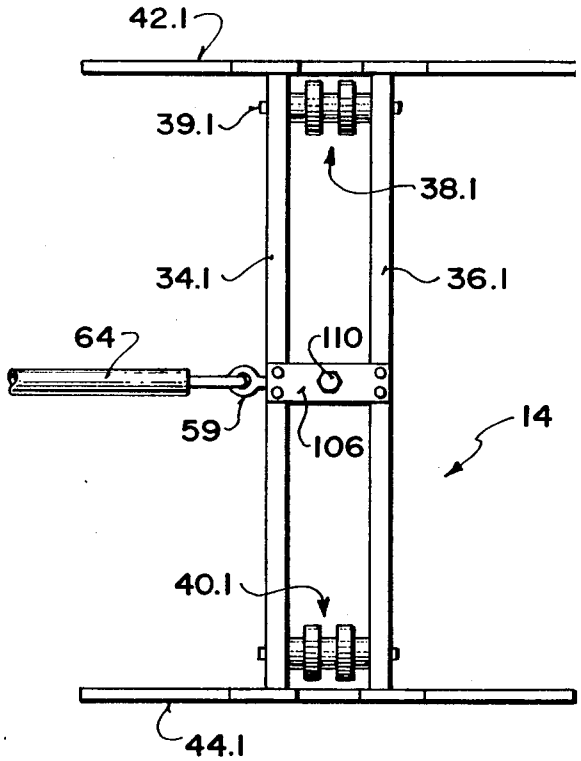
FIG. 5 is a simplified plan view of the support of an alternate embodiment of the invention.
Figure 8:
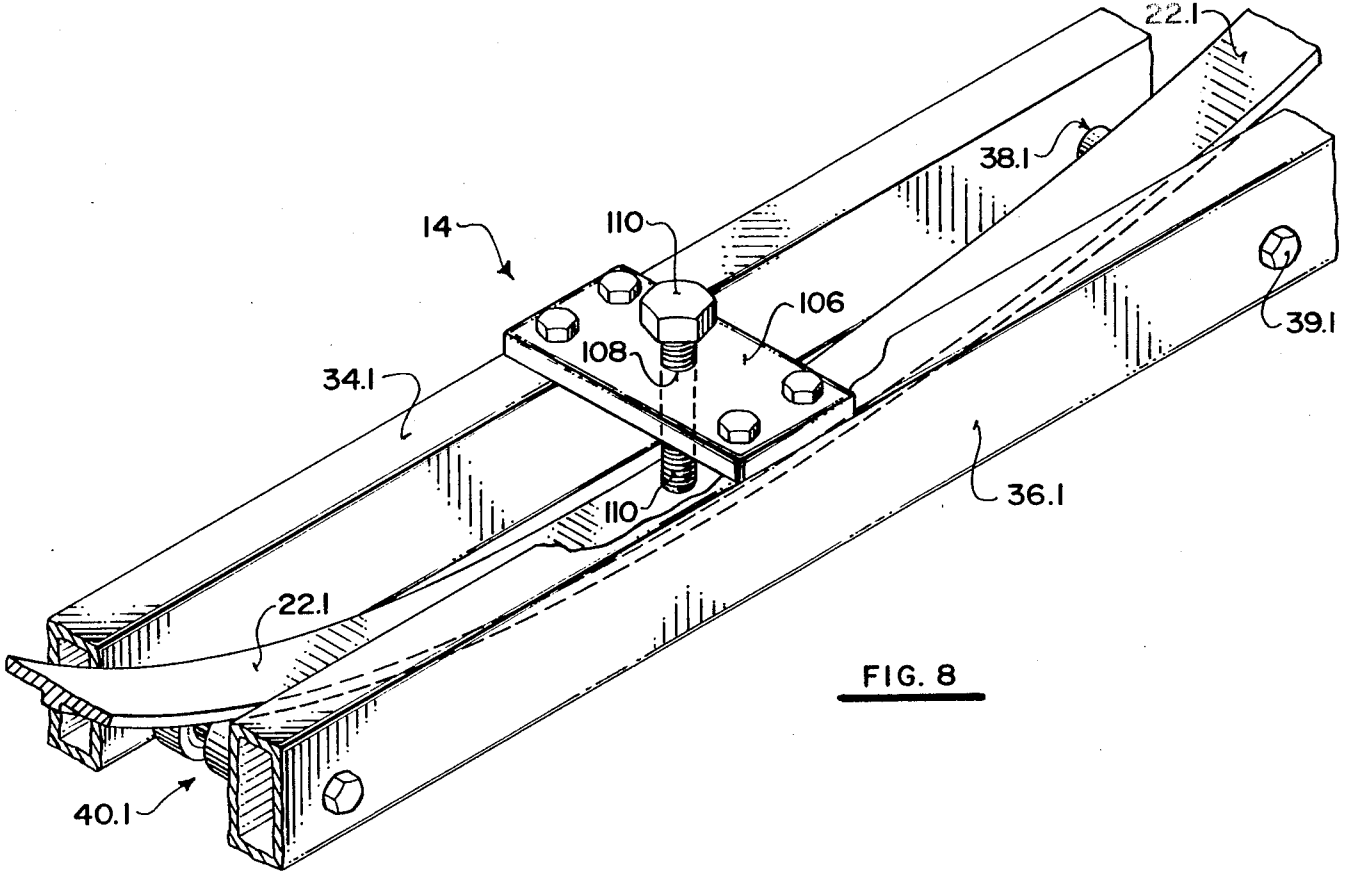
FIG. 8 is a simplified fragmentary perspective view of the brake device of the alternate embodiment of FIG. 5.

In an alternative embodiment of the invention, shown in FIGS. 5 and 8 the braking means is slightly different from that described in the preferred embodiment. Otherwise, similar parts have the same reference numbers as in the previous embodiment with the addition of "0.1". Apparatus 14 includes a second cross-member 106 having a threaded opening 108, the cross-member 106 being connected between the guide members 34.1 and 36.1. A threaded member, such as a bolt 110, threadedly engages the threaded opening 108. The bolt 110 extends below the cross-member 106 and is operable to apply clamping pressure against the top of arcuate member 22.1, thereby stopping rotation of the arcuate member. The bolt 110 and the cross member 106 provide first clamping means for clamping the arcuate member 22.

OPERATION

Referring to FIGS. 2, 4 and 5, a vehicle 10 is positioned over a surface 11 on which the first and second apparatuses 12 and 14 are placed in a spaced-apart relationship, conventionally by driving it into this position.

Referring to FIGS. 5 and 8 turning member 16 of the second apparatus 14 is positioned such that the cross member 32.1 is generally horizontal. The bolt 110 is then screwed into the threaded opening 108, thereby exerting clamping pressure between cross-member 106 and the arcuate member 22.1. The second apparatus 14 is thus adjusted for mounting the vehicle thereon.

The vehicle 10 is jacked up in the conventional manner to a height sufficient to enable the apparatus 14 to be positioned for mounting the vehicles front wheel hubs to the wheel hub brackets on the apparatus. These wheel hubs are not shown, but are identical to brackets 58 and 60 of apparatus 12. The track adjustment members of apparatus 14, equivalent to members 98 and 102 of FIG. 3 are positioned to accommodate the track width of the vehicle. The clamp members of the second apparatus, equivalent to members 100 and 104 shown in FIG. 3 are operated to secure the track adjustment members in the required track position for mounting of the wheel hubs.

Referring to FIG. 7, the first and second wheel hub brackets of apparatus 14 are positioned vertically, using openings equivalent to openings 78 and 94 respectively of the first apparatus and are secured in position by equivalent first and second bolts identical to the bolts illustrated at 80 and 96. The wheel hub brackets are secured to the rear wheel hubs of the vehicle using the vehicles wheel hub bolts identical to the bolts illustrated at 74 and 90.

The wheel hub brackets may be initially loosely attached to the wheel hubs, to allow positioning of the apparatus 14, to place the longitudinal center of mass of the vehicle coincident with the center 26 of the circle 24, shown in FIG. 2. The wheel hub brackets are then tightly secured in their respective positions using the bolts equivalent to those shown at 80 and 96 and using the clamp members equivalent to those shown at 100 and 104.

With the apparatus 14 attached to the front of the vehicle, the rear of the vehicle may be jacked up, the wheels removed, and the first apparatus 12 may be prepared for connection to the rear wheel hubs of the vehicle.

Referring to FIG. 6, the first apparatus 12 is prepared for mounting by rotating the rod 46 to move the lobe 50 on the cam 48, thereby rotating the pawl 52 about the pivot pin 53 out of an interdental space 56. With the pawl 52 so pivoted, the turning member may be positioned so as to place the first cross member 32 (shown in FIG. 3) in a generally horizontal position parallel to the surface 11, on which the first apparatus 12 is supported. With the turning member so positioned, the rod 46 is rotated so as to move the lobe 50 of the cam 48 to rotate the pawl 52 about the pivot pin 53 into one of the interdental spaces 56, thereby locking the turning member 16 in the mounting position.

The first apparatus 12 is then positioned under the rear wheel hubs of the vehicle 10, to place the center 26 of the circle 24 coincident with the longitudinal center of mass of the vehicle 10 as shown in FIG. 2. With the first apparatus positioned as desired, the wheel hub brackets 58 and 60 may be secured in position by the bolts 80 and 96 and the clamp members 100 and 104.

To enable rotation of the vehicle 10, the brake on the second apparatus 14 is released by loosening bolt 110, thereby relieving the pressure between the cross member 106 and the arcuate member 22.1. In addition, apparatus 12, rod 46 is rotated to move the lobe 50 of the cam 48 to rotate the pawl 52 about the pivot pin 53 away from the interdental space 56. To rotate the vehicle 10, the operator applies pressure to the first foot pedal 112 or the second foot pedal 116, thereby rotating the vehicle 10 in either the clockwise or counter-clockwise direction.

The vehicle may be locked in any rotated position by moving the rod 46 on apparatus 12 to rotate the pawl 52 about the pivot pin 53 to engage in any desired space 56. With the pawl 52 engaged within a space 56, the turning member 16 and hence the vehicle 10 is prevented from rotational movement about the longitudinal center of mass of the vehicle.

The apparatus described herein are by way of preferred example only. Other apparatuses may be devised which accomplish the same purposes.

What is claimed is:

1. An apparatus for turning a vehicle on its side, about a generally horizontal first axis of rotation, the apparatus comprising:

(a) a turning member including an arcuate member and bracing means, the arcuate member having first and second end portions and having a center of curvature coincident with the first axis of rotation, the bracing means being for bracing the arcuate member;

(b) supporting means rotatably connected to the turning member for supporting said turning member for rotation about the first axis of rotation, the supporting means including stabilizing means for stabilizing the supporting means to prevent tipping, said stabilizing means including a first guide member, a second guide member parallel to and spaced apart from said first guide member, a first bearing rotatably disposed between said first and second guide members, a second bearing parallel to and spaced apart from said first bearing, said second bearing being rotatably disposed between said first and second guide members, the turning member resting on said first and second bearings for rotation of the turning member about the axis of rotation;

(c) braking means operatively between the turning member and the supporting means for braking rotational movement of the turning member relative to the supporting means, the braking means including a rod member rotatably mounted on said supporting means to permit longitudinal rotation of said rod member, a cam member having a lobe portion, said cam member being connected to the rod member, a pawl member pivotally connected to the supporting means, the pawl member being contacted by the lobe portion of the cam member to pivot the pawl member, a plurality of spaced apart tooth members connected to the turning member, the pawl member being selectively engagable between said tooth members;

(d) first and second connecting means on the turning member for connecting first and second wheel hubs of the vehicle to the turning member, the first connecting means including a wheel hub bracket for mounting a first wheel hub thereto and the second connecting means including a second wheel hub bracket for mounting a second wheel hub thereto;

(e) positioning means for positioning the first and second connecting means to align the first axis of rotation with the longitudinal center of mass of the vehicle, the positioning means including first and second adjusting means for adjusting the first and second connecting means relative to the first axis of rotation, the first adjusting means providing adjustment in a generally vertical plane and the second adjusting means providing adjustment in a generally horizontal plane, said vertical and horizontal planes being relative to a surface on which said apparatus is positioned when said apparatus is positioned in an initial orientation for receiving a vehicle prior to securing the vehicle thereon, the second adjusting means further including first and second clamp members operable to be attached to said bracking means near said first and second end portions of said arcuate member and first and second track adjustment members operable to be clamped fast by said first and second clamp members respectively.

2. An apparatus as claimed in claim 1, wherein the supporting means includes an elongated support member and outriggers connected thereto.

3. An apparatus as claimed in claim 1, further comprising transporting means for transporting the apparatus across a surface.

4. An apparatus as claimed in claim 3, wherein the transporting means includes a plurality of casters operably connected to the supporting means.

5. An apparatus as claimed in claim 1, wherein the arcuate member has a rail conforming to an arc of a circle.

6. An apparatus as claimed in claim 5, wherein each of said bearings both includes rollers which are spaced-apart to receive the rail therebetween.

7. An apparatus as claimed in claim 1, wherein:

(a) the first mounting means includes:

(i) first and second projections having first and second openings respectively for receiving receive wheel hub bolts of the wheel hubs;

(b) the first wheel hub bracket includes:

(i) a third projection having a third opening to receive a first fastening means for fastening the first wheel hub bracket to the turning member;

(c) the second receiving means includes:

(i) fourth and fifth projections having fourth and fifth openings respectively operable to receive wheel hub bolts of the wheel hubs;

(d) the second wheel hub bracket includes (i) a sixth projection having a sixth opening to receive a second fastening means for fastening the second wheel hub bracket to said turning member.

8. An apparatus as claimed in claim 1, wherein:

(a) said first and second connecting means include first and second wheel hub brackets respectively;

(b) said first adjusting means includes;

(i) third and sixth projections operatively attached to said first and second wheel hub brackets respectively, said third and sixth projections having third and sixth openings respectively, to accommodate first and second fastening means respectively, for fastening the first and second wheel hub brackets to the turning member.

9. An apparatus for turning a vehicle on its side about a generally horizontal first axis of rotation, the apparatus comprising:

(a) a turning member having an arcuate member with first and second end portions, said arcuate member having a center of curvature coincident with the first axis of rotation;

(b) supporting means rotatably connected to the turning member for supporting said turning member for rotation about the first axis of rotation;

(c) braking means operatively between the turning member and the supporting means for braking rotational movement of the turning member relative to the supporting means, the braking means including first clamping means for clamping the arcuate member to the supporting means, the first clamping means being operatively attached to the supporting means, and including a cross member connected to the supporting means, said cross member having a threaded opening for receiving a threaded member being threadedly engagable with said threaded opening, said threaded member being extendable below said cross member to engage the arcuate member;

(d) first and second connecting means on the turning member for connecting first and second wheel hubs of the vehicle to the turning member; and (e) positioning means for positioning the first and second connecting means to align the first axis of rotation with the longitudinal center of mass of the vehicle, the positioning means being operatively connected to the first and second connecting means.

* * * * *